US005599239A

United States Patent [19]

Kim et al.

[11] Patent Number: 5,599,239

[45] Date of Patent: Feb. 4, 1997

[54] HEADWATCHER

[76] Inventors: Cheol K. Kim, 175 Solana Dr., Los Altos, Calif. 94022; Lambert A. Ling, 5228 Cass St. #2, San Diego, Calif. 92109; James J. Kim, 2909 Bay Village Cir. #2003, Santa Rosa, Calif. 95403

[21] Appl. No.: 568,740

[22] Filed: Dec. 7, 1995

[51] Int. Cl.[6] ..... A63B 69/36

[52] U.S. Cl. ..... 473/208; 473/267

[58] Field of Search ..... 473/207, 208, 473/209, 210, 221, 224, 225, 266, 267, 274

[56] References Cited

U.S. PATENT DOCUMENTS

| | | | |
|---|---|---|---|
| 3,109,654 | 11/1963 | Comitz . | |
| 3,729,200 | 4/1973 | Hines et al. . | |
| 4,560,166 | 12/1985 | Emerson | 473/209 |
| 4,630,829 | 12/1986 | White | 473/221 |
| 4,762,325 | 8/1988 | McCleery . | |
| 4,971,325 | 11/1990 | Lipps | 473/209 |
| 5,056,791 | 10/1991 | Paillon et al. . | |
| 5,067,717 | 11/1991 | Harlan et al. | 473/207 |
| 5,087,047 | 2/1992 | McConnell | 473/221 |
| 5,111,410 | 5/1992 | Nakayama et al. | 473/221 |
| 5,171,152 | 12/1992 | McCleery . | |
| 5,263,719 | 11/1993 | Bunn . | |
| 5,275,403 | 1/1994 | Jones . | |
| 5,338,037 | 8/1994 | Toyohara . | |
| 5,342,054 | 8/1994 | Chang et al. . | |

*Primary Examiner*—Jessica Harrison
*Assistant Examiner*—James Schaaf
*Attorney, Agent, or Firm*—Steve A. Wong

[57] ABSTRACT

A device which monitors the head turn movement of a golfer during a golf swing. It gives the golfer instantaneous feedback by informing him whether his head turned prior to or after the golf club struck the ball. This feedback is done in the form of a digital LCD display of the time difference in milliseconds and also in the form of audible beeps. From this information, the golfer can make the necessary adjustments and corrections in the execution of his swing. The device is compact and portable. It is placed near the golf ball such that the ball lies directly between the golfer and the device. After the information is displayed, the device automatically resets and readies itself to monitor the next golf swing.

6 Claims, 7 Drawing Sheets

FIG. 1
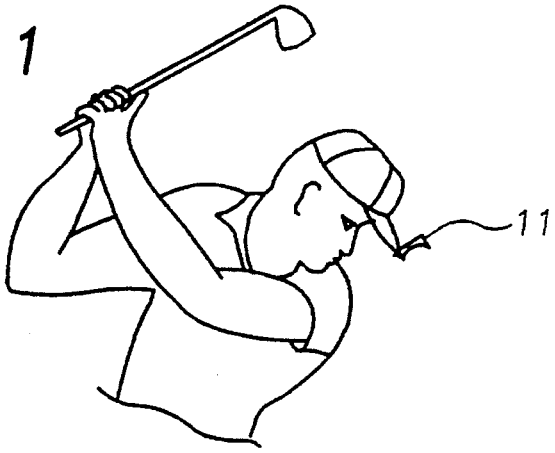
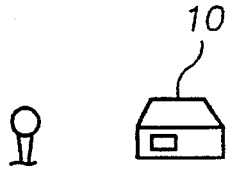
FIG. 2
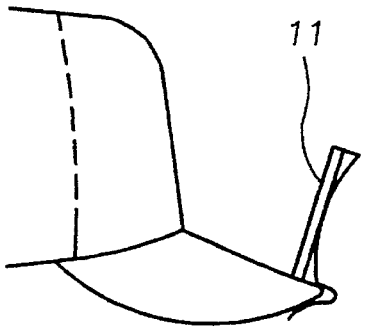
FIG. 3
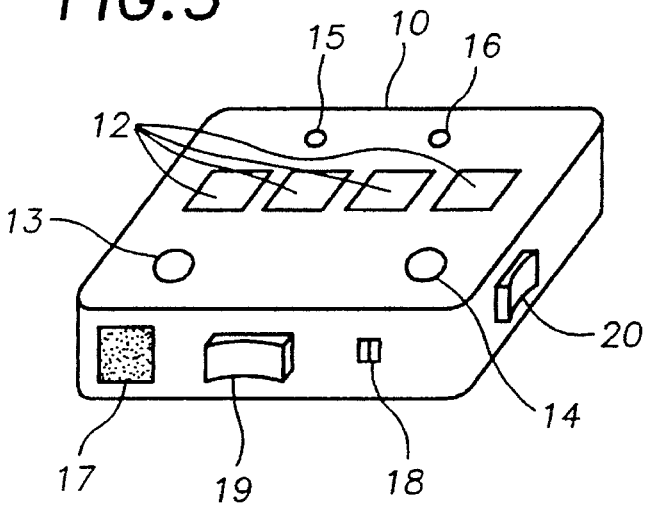

ALIGNMENT FUNCTION

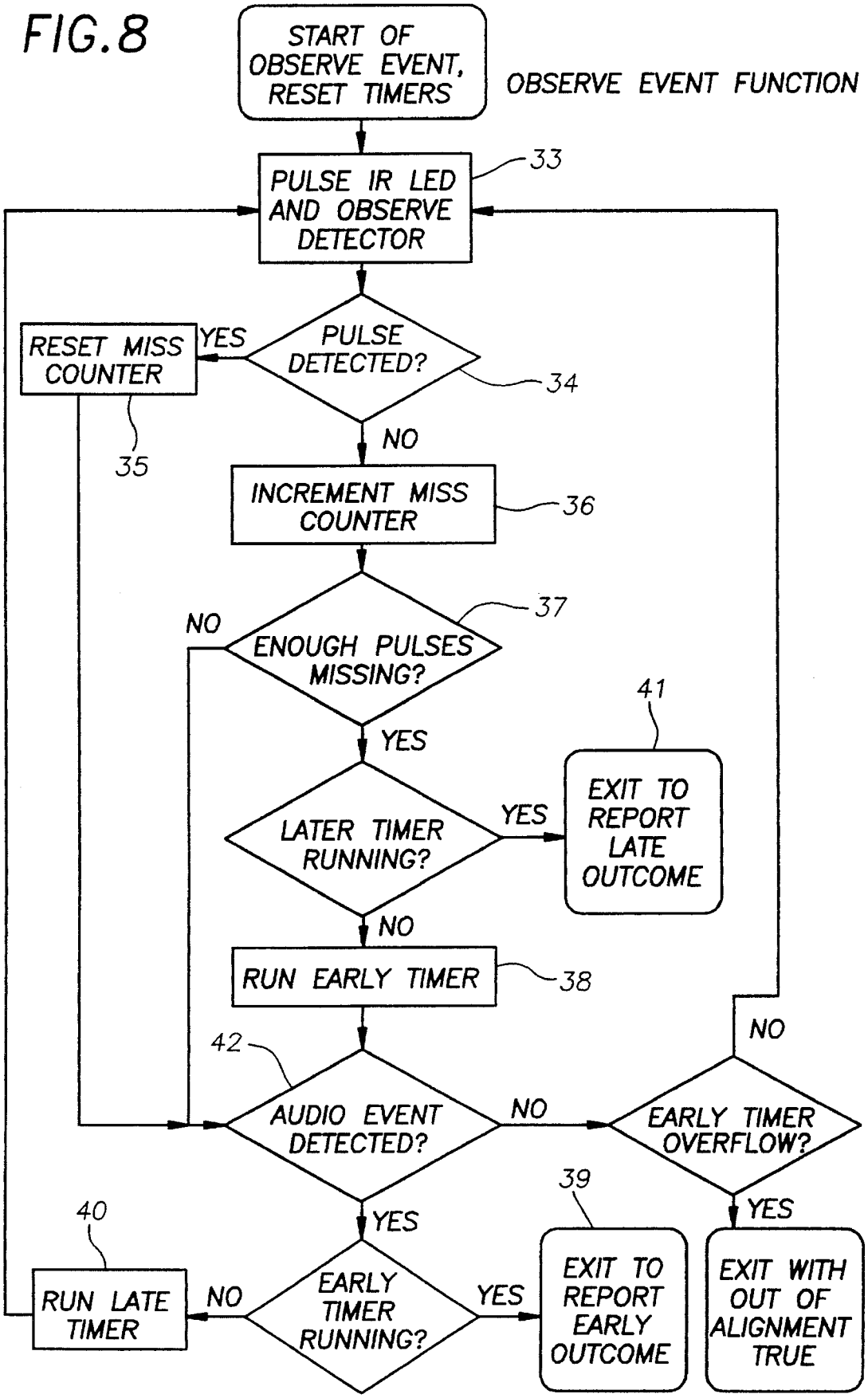
FIG. 8
START OF OBSERVE EVENT, RESET TIMERS
OBSERVE EVENT FUNCTION
PULSE IR LED AND OBSERVE DETECTOR
33
PULSE DETECTED?
34
YES
RESET MISS COUNTER
35
NO
INCREMENT MISS COUNTER
36
ENOUGH PULSES MISSING?
37
NO
YES
LATER TIMER RUNNING?
YES
EXIT TO REPORT LATE OUTCOME
41
NO
RUN EARLY TIMER
38
AUDIO EVENT DETECTED?
42
NO
EARLY TIMER OVERFLOW?
NO
YES
YES
EXIT TO REPORT EARLY OUTCOME
39
EXIT WITH OUT OF ALIGNMENT TRUE
EARLY TIMER RUNNING?
YES
NO
RUN LATE TIMER
40

REPORT OUTCOME FUNCTION

HEADWATCHER

BACKGROUND

The game of golf is one of the most popular sport in the United States and is enjoyed around the world. More and more golfer's take their game very seriously and are constantly striving to improve their game performance. An integral part of a golf game is the golfer's swing, and it is well known that proper form during a golf swing is crucial in maintaining and improving one's skill in the game. The distance and accuracy of the golf ball's flight after being struck by a club is dependent on the golfer's proper stance and form before, during and after the swing. One important factor in determining the golfer's proper form is the ability to maintain eye contact with the ball up through the moment the golf club strikes the ball.

It has been established that excessive head movement during a golf swing will usually result in the club head not making proper contact with the ball, or when contact is made, the optimum amount and direction of impact is not properly attained. As such, inexperienced golfers are constantly instructed to watch the position of the ball after being struck, and not to lift or turn the head until after the swing has been substantially completed. This is because the position and movement of the head determines where the eyes are focused. When the golfer's head turns away too soon, it means that the eyes have also turned away too soon. Such undesirable head, and eye, movements during a golf swing are one of the most problematic areas for the golfer to notice and correct. Generally, the golfer's swing has to be observed by an instructor to detect such premature head movements, and thus, to correct it. Naturally, this can amount to high financial costs due to the instructor's fee and also inconvenience due to unavailability of an instructor when the golfer wishes to practice. Another means to monitor a golfer's swing is to use video camcorders which can record the golfer's swing. These camcorders are generally standard video recorders which require rewinding of the tape before replay. The obvious disadvantage here is that the response time for the golfer is limited as valuable time is wasted manipulating the video recording equipment and the golfer is deprived of a near instantaneous feedback of his head movements during the swing.

Even if the golfer realizes that his head is turning away from the ball before the club strikes the ball, there is no way to determine exactly the amount of time before the club strikes the ball does the head turn away. Knowing that amount of time would give the golfer a quantifiable measure, or a margin or error, in which he can the gauge his swing performance and measure any subsequent improvements. Therefore, there is a need to provide instantaneous feedback to the golfer as to whether his head turned away from the ball prior to moment the club strikes the ball and if so, by exactly how much time. Obviously, this need must be met by a cost effective, reliable and portable method or device.

SUMMARY

Against the foregoing background, the present invention is directed to a device which satisfies the need to give a golfer instantaneous feedback as to whether his head turned away from the ball prior to the moment the club strikes the ball and in such event, by exactly how much time. The device is also extremely reliable, highly portable and relatively inexpensive.

In its broadest form, the invention comprises a device which performs the following functions: determines when a golfer's head is aligned with the golf ball; determines when the golf club strikes the ball; determines when the golfer turns his head away from the ball during the swing; determines whether the golfer turned his head before or after the club strikes the ball; calculates the time difference from the time the head turns away to the time the club strikes the ball or vice versa; and provides instantaneous feedback of the results to the golfer. In the preferred embodiment, the device is composed of electrical circuitry and components housed in a compact enclosure and powered by a battery. This allows it to be very portable such that the golfer can take the device with him anywhere and use it anytime.

To use the device, the golfer merely places it near the golf ball such that the ball lies directly in line between the device and the golfer himself as he addresses the ball, turns the device on, wears a reflector on or about the front of his head, and is ready to start hitting golf balls. While activated, the device will inform the golfer if his head turned away from the ball before of after the swing. This information is conveyed to the golfer by several means, including visual indication (digital display and/or lighted indicators), audible sounds, and tactile stimulation (vibration). The preferred embodiment of the invention uses both a digital display and lighted indicators, and emits audible tones from a piezoelectric transducer.

The audible means consists of a steady beep when his head turned away after the club strikes the ball, as this is indicative of a successful swing execution, and a series of short beeps if his head turned away prior to the club striking the ball. The visual reporting means consists of activating a steady amber light emitting diode when his head turned away after the club strikes the ball, and a flashing red light emitting diode if his head turned away prior to the club striking the ball. The visual means also includes a digital liquid crystal display (liquid crystal display) which shows the elapsed time between the head turning time and the ball strike time in milliseconds. The results are displayed for about 10 seconds, after which the device resets and readies itself for the next swing.

BRIEF DESCRIPTION OF THE DRAWINGS

The features, advantages and objects of the present invention will become apparent from the following detailed description of a preferred embodiment thereof, taken in conjunction with the accompanying drawings in which:

FIG. 1 illustrates the head monitoring device embodying the present invention as used by a golfer during a golf swing;

FIG. 2 is an illustration of the reflector attached to the brim of a cap;

FIG. 3 is a perspective illustration of the head monitoring device;

FIGS. 7–9 are flowcharts of software routines carried out by the preferred embodiment to determine head alignment, observe event, and report of outcome of events, respectively.

DESCRIPTION

Figure 4:
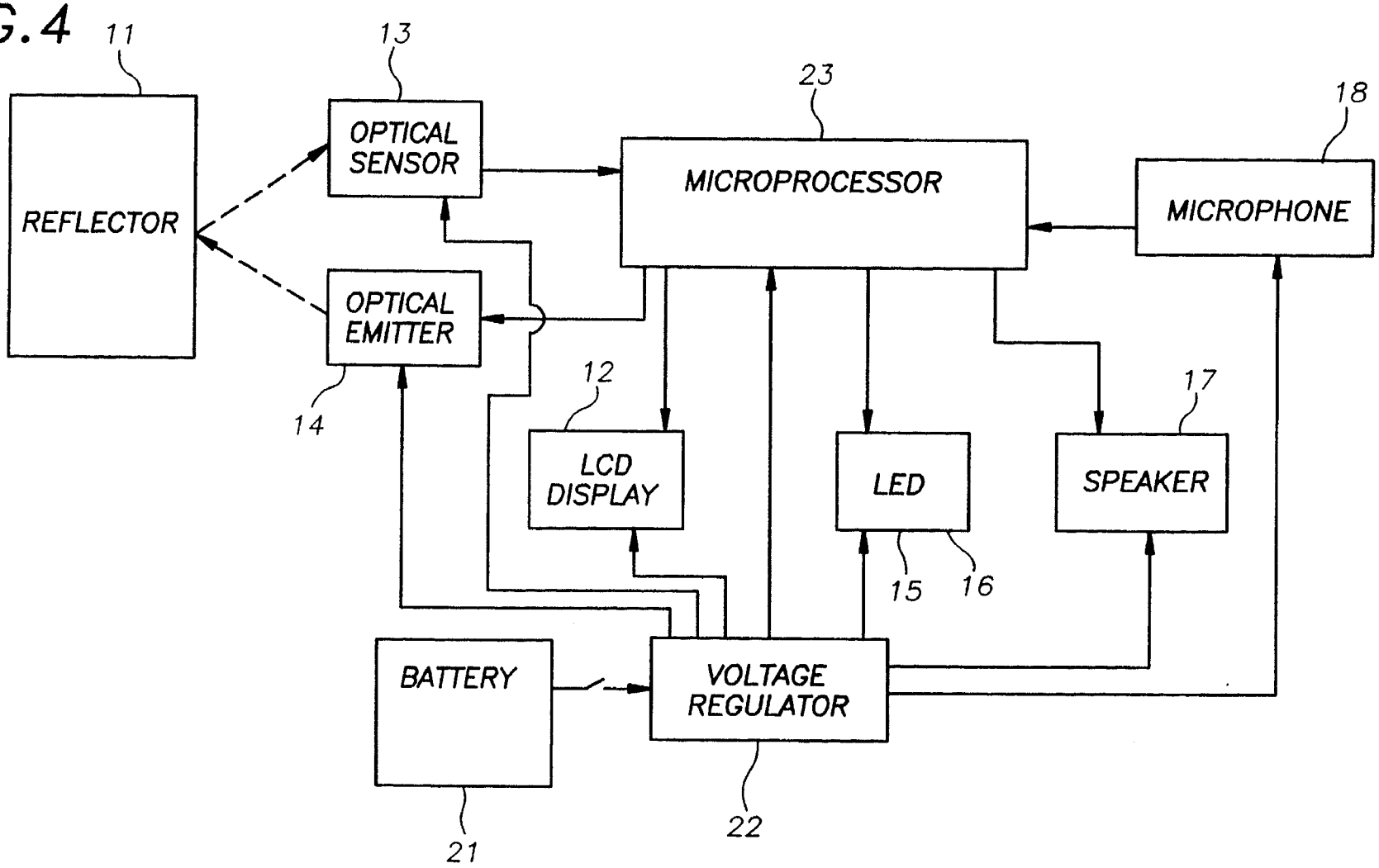
FIG. 4 is a block diagram of the head monitoring device and its associated elements as used in the preferred embodiment of the invention.

FIG. 1 illustrates the use of the preferred embodiment of the invention by a golfer swinging at a golf ball. The device 10 is placed directly in front of the golfer and the golf ball such Chat the ball lies in between the golfer and the device 10. Ideally, the device 10 should be placed as close to the ball as possible. The device 10 uses a reflector 11 to reflect an infrared signal to the device 10.

The reflector 11 can be attached to a golfer's hat as depicted in FIG. 2 or otherwise mounted onto a headband worn by the golfer about his head. A pair of glasses with highly reflective mirrored lenses worn by the golfer can also serve as the reflector.

The preferred embodiment of the device 10 is shown in FIG. 3. A power switch 20 activates the device. An optical emitter 14 sends an infrared signal when the golfer addresses the ball in preparation for a swing. An optical sensor 13 detects the infrared signal reflected from the reflector 11. A microphone 18 detects the sound emanating from the point the golf club struck the golf ball. A liquid crystal display 12 shows the time difference in milliseconds from when the ball was struck to when the golfer turned his head away from the ball. The red light emitting diode 15 blinks to inform the golfer he turned his head away before the golf club struck the ball. The amber light emitting diode 16 glows to inform the golfer he turned his head away after the golf club struck the ball, thus indicating he successfully executed the swing. A piezo speaker 17 produces two short beeps to inform the golfer he turned his head away before the golf club struck the ball, and one long beep to inform the golfer he turned his head away after the golf club struck the ball. The piezo speaker 17 can be turned off by the switch 19.

Referring to FIG. 4 a block diagram is shown depicting the microprocessor 23 and its relationship to the other elements which constitute the device. The microprocessor 23 receives power from a battery 21 and the voltage from the power source is regulated to 5 volts by a voltage regulator 22. The microprocessor receives signals and controls an optical emitter 14 which emits an infrared signal when commanded by the microprocessor 23. The optical reflector 11 detects the infrared signal from the optical emitter 14 and reflects this signal. The reflected optical signal is detected by an optical sensor 13 which sends a signal to the microprocessor 23. The microprocessor 23 also receives a signal from a microphone 18 which detects the sound caused when the golf club strikes the golf ball. The microprocessor 23 analyzes the signals received from the optical sensor 13 and microphone 18, and using a software program described below, determines whether the signal from the microphone 18 was received before or after the signal from the optical sensor 13 was terminated and the time difference between the two signals. The microprocessor 23 then sends an output signal to a liquid crystal display drive 23a which drives the digital liquid crystal display 12 to produce a digital readout. The microprocessor 23 also sends output signals to the piezo-speaker 17 and light emitting diodes 15 and 16. The functions performed by the microprocessor 23 are dictated from a software algorithm encoded into the microprocessor 23.

Figure 5:
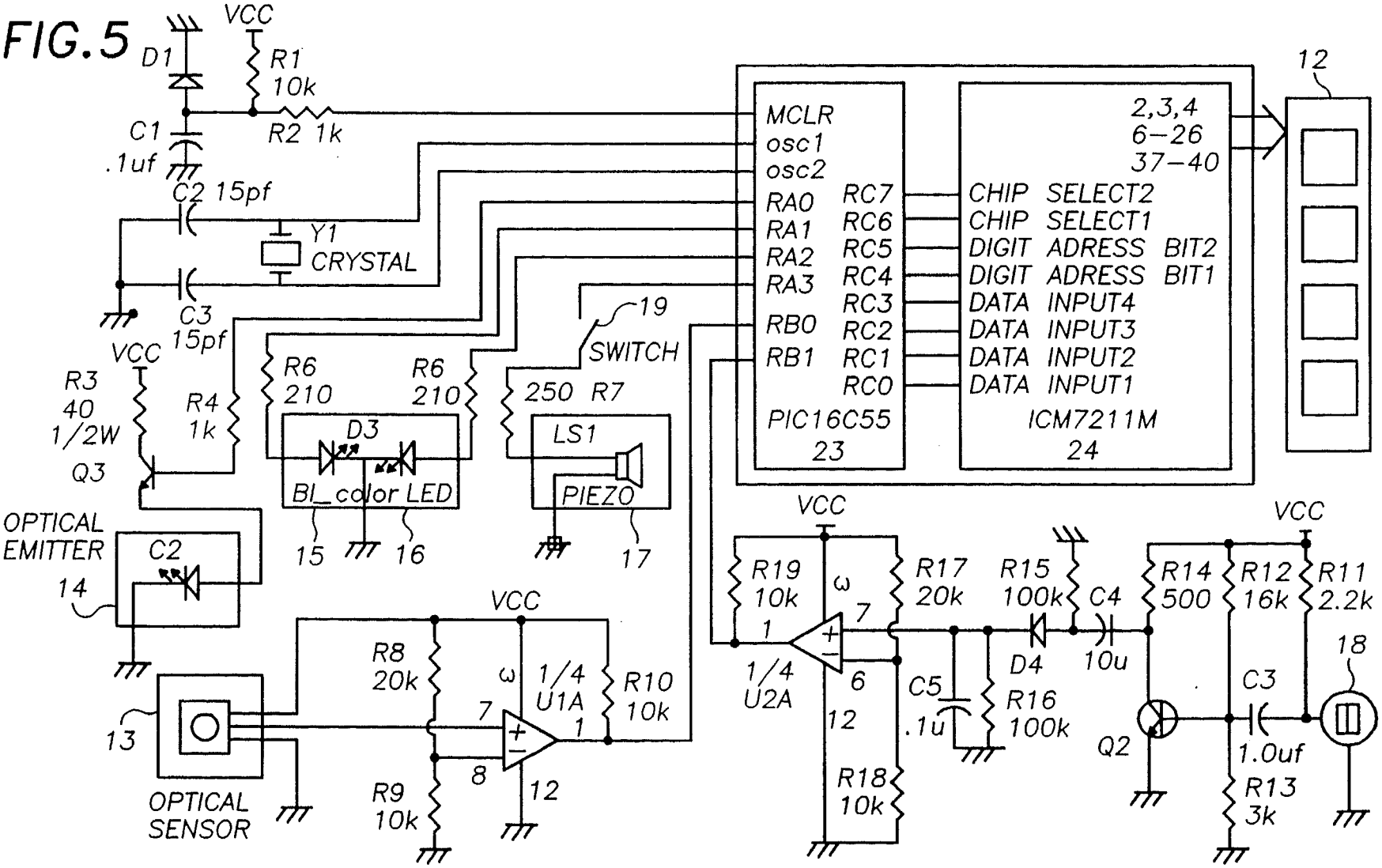
FIG. 5 is a schematic diagram of the head monitoring device as used in the preferred embodiment of the invention.

A detailed circuit diagram to the device is shown in FIG. 5. When the Optical Sensor 13 detects an infrared signal, it converts the optical signal to an electrical signal which is sent to the microprocessor 23. Similarly, the acoustic input from the microphone 18 is converted to an electrical signal which is sent to the microprocessor 23. The detection algorithm itself may be implemented in several ways, including discrete digital circuitry, a custom integrated circuit which performs an algorithm, or a general purpose microprocessor or microcontroller programmed with software code which performs an algorithm. In the preferred embodiment of the invention, an 8-bit microcontroller programmed with an algorithm is utilized. The microprocessor 23 is a Microchip PIC16C55 8-bit controller. The PIC16C55 is a single-chip microcontroller device that contains microprocessor logic, timer logic, program memory, and data memory in a single integrated circuit package. The PIC16C55 also has sufficient digital inputs and outputs to control all of the detection and reporting circuitry in the device.

Figure 6:
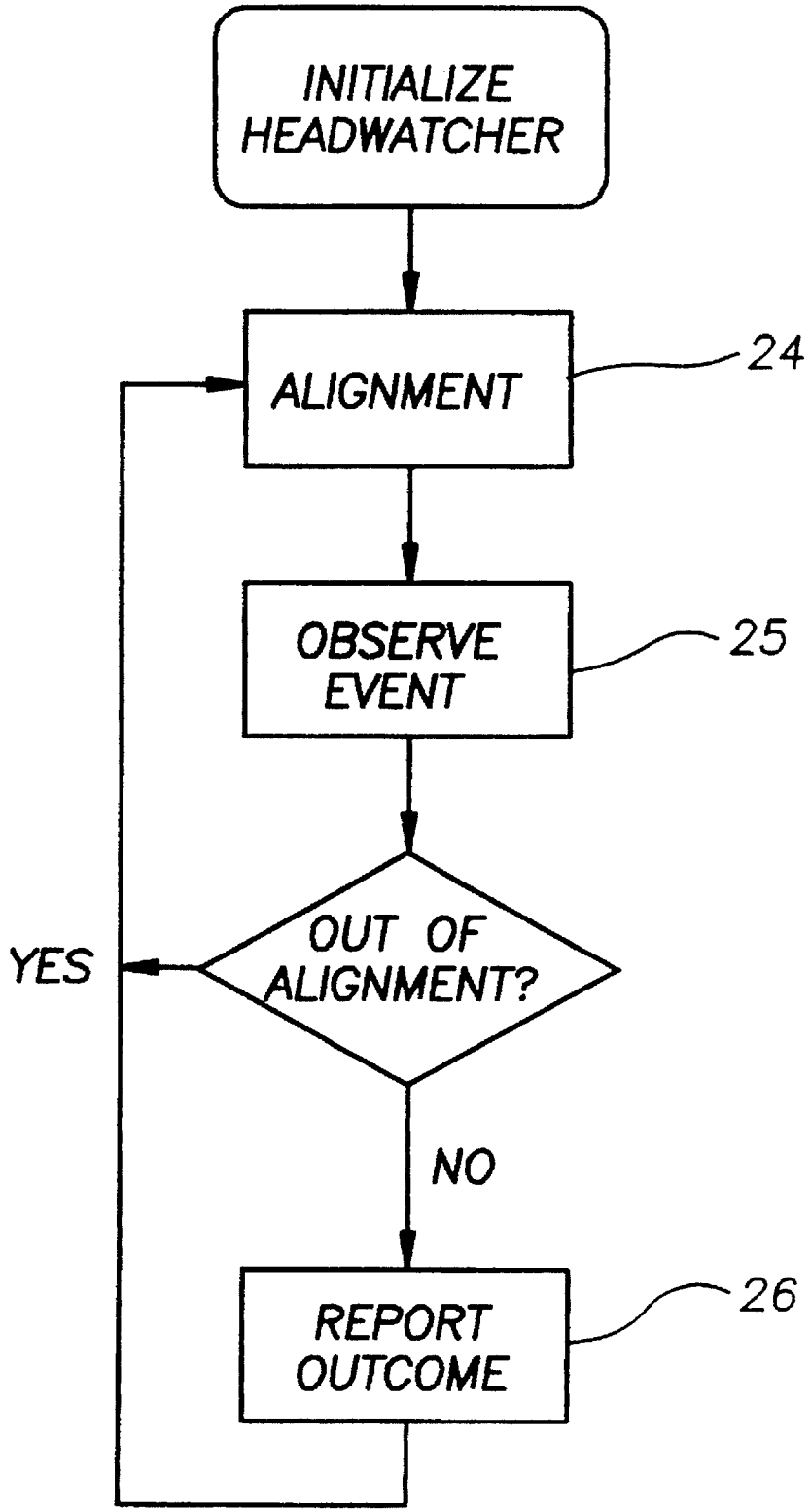
FIG. 6 is a flowchart of the software employed by the preferred embodiment of the invention.

Turning now to FIG. 6 the software algorithm which is encoded in the microprocessor consists of three basic tasks. The first is Alignment 24 where the golfer's head alignment with the ball is checked. The golfer's head is considered aligned with the ball when the had is facing the ball with no more than a 3 degree deviation to either the left or right side of the golf ball. The second is Observe Event 25 where the golfer's head movement is detected and golf club contact with the golf ball is detected. The third task is Report Outcome 26 provides the result of the golfer's swing performance.

Figure 7:
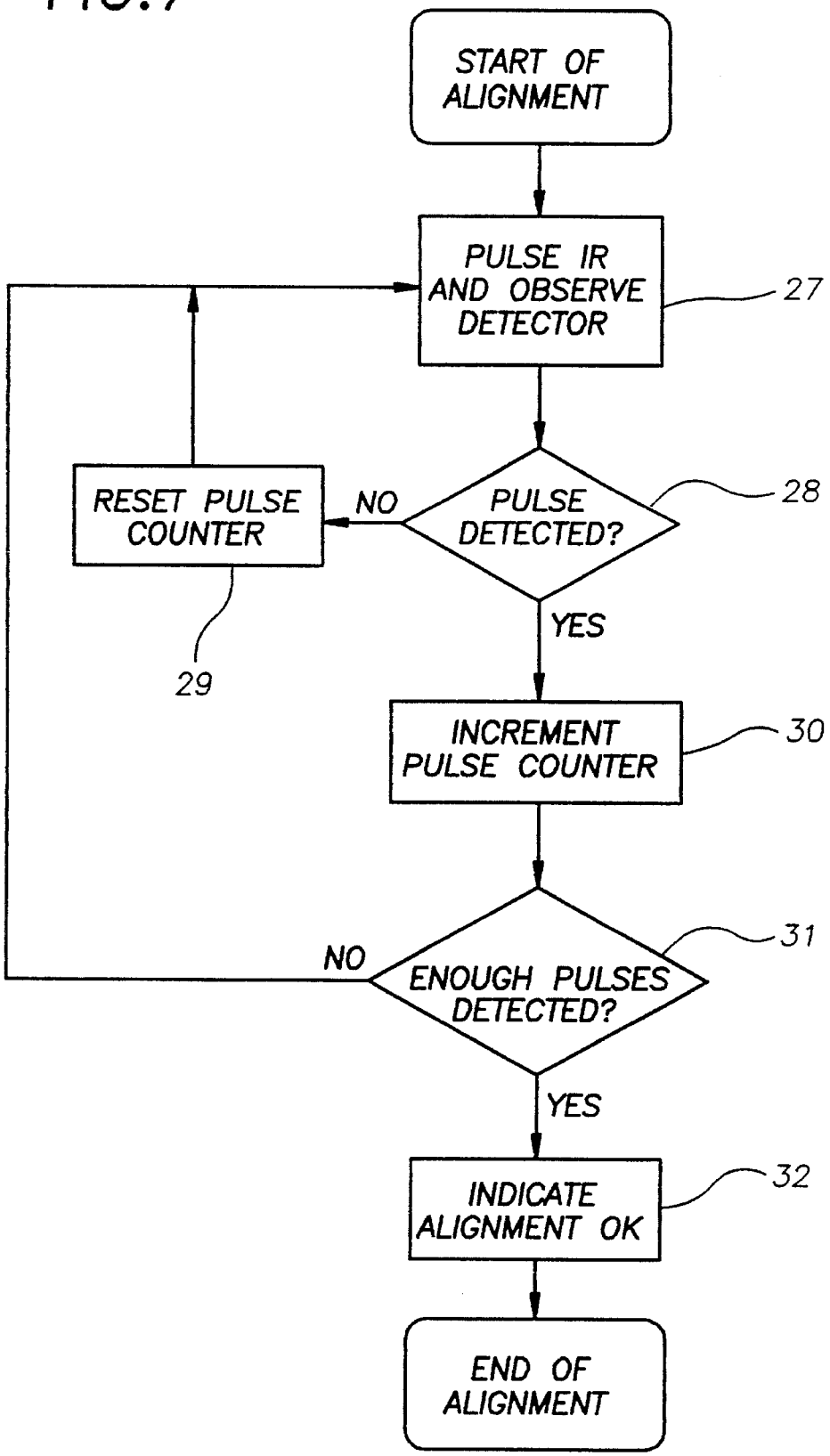

FIG. 7 is a flowchart of the Alignment task. The golfer's head is properly aligned with the ball when the reflector (worn by the golfer on a headband or cap) reflects the infrared signal from the device back into the optical sensor. The alignment process involves pulsing the optical emitter and observing the optical detector 27. In the preferred embodiment, the optical emitter is an infrared light emitting diode. The program continues by checking whether the optical sensor detected a pulse 28. If not, the device resets a pulse counter 29. If the optical sensor detects a pulse, then a pulse counter is incremented 30. If sufficient consecutive pulses are detected 31, a visual indication is provided for the golfer by an light emitting diode on the device 32 and the software program proceeds to the next task. If pulses are missed by the detector, the head is considered out of alignment and the pulse counter is reset 29

The next task performed by the software program is the Observe Event task as shown in FIG. 8. During the Observe Event task, the device waits for two distinct events to occur:

1. Enough Pulses Missing 37, when the head turns and causes a loss of alignment with the ball
2. Audio Event Detected 42, the sound of the club striking the ball.

Figure 9:
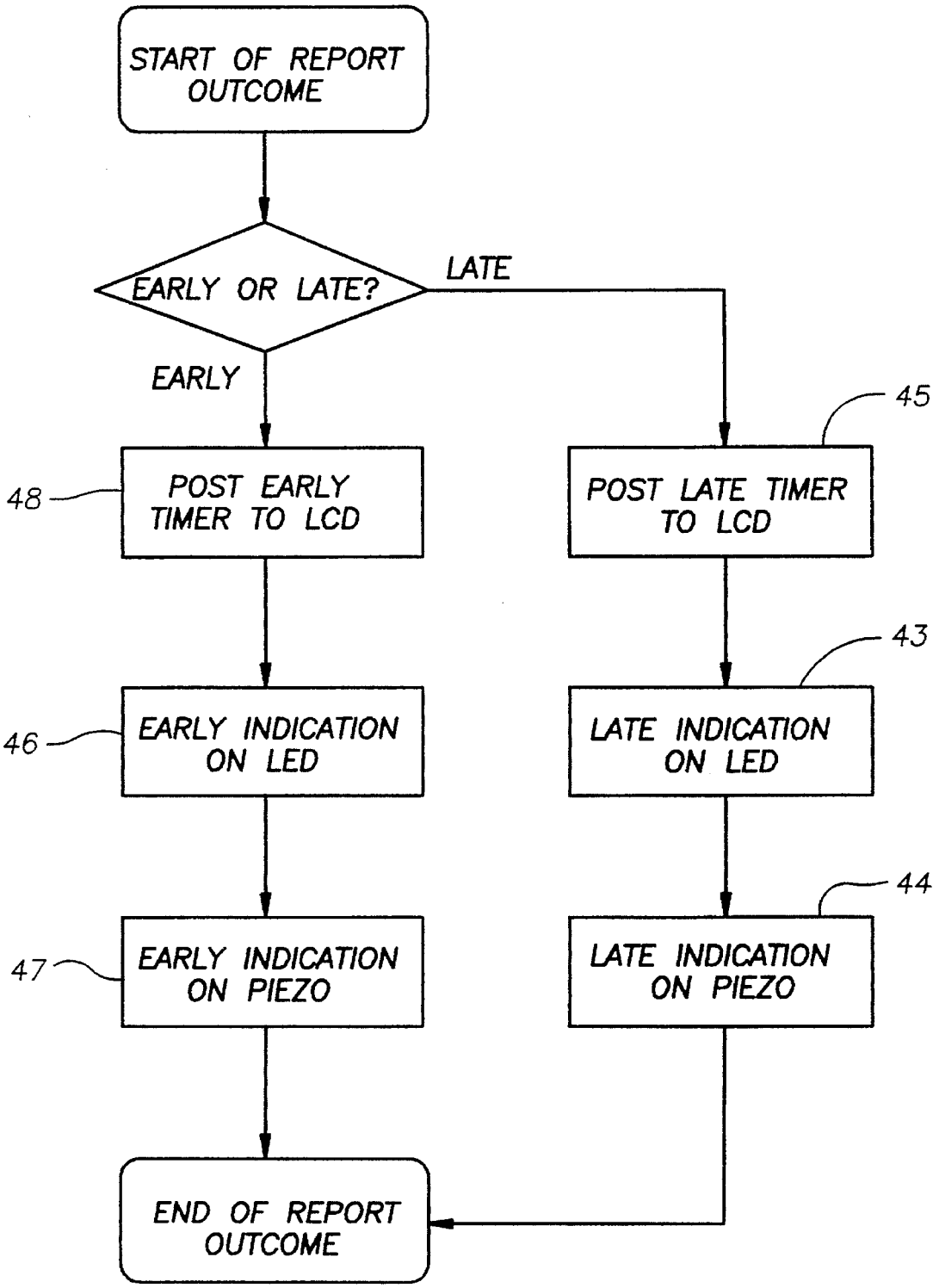

The Observe Event task begins by pulsing the optical emitter and observing the optical sensor 33. The program continues by checking whether the optical sensor detected a pulse 34. As long as infrared signals are detected, the head is considered aligned. If the optical sensor does not detect a pulse, then a miss counter is incremented 36. When enough consecutive infrared pulses are missed by the detector 37, the device determines that the head has moved. If the sound of the club striking the ball has not yet occurred, a counter is started to time the interval from the head turning until the sound made by contact of the club with the ball 38. In this case, the golfer has turned his head too soon and the program exits to report early outcome 39 as depicted in FIG. 9. If the sound of the contact with the ball occurs while the head is still aligned, the device starts a counter to time the interval from the instant of ball contact until the head turns 40. In this case, the golfer has correctly executed his swing, keeping his head aligned with the ball (and the device) until after the club makes contact, and the program then exits to report late outcome 41 as depicted in FIG. 9.

If head alignment is lost during the Observe Event task and there is no accompanying audio event (caused by the club striking the ball) which occurs within a specific time interval (about one second), the device assumes that the golfer has turned his head to judge his shot, or that he is otherwise not ready to execute the swing. In this situation, the device aborts the Observe Event task and goes back to the Alignment task.

The final task in sequence performed by the software program is the Report Outcome task as depicted in FIG. 9. The outcome of the Observe Event task is now reported to the golfer in three ways, a digital liquid crystal display, visual light emitting diodes, and an audible tone from a piezo buzzer. If the execution of the swing was correct, and the head turned subsequent to the contact with the ball, then the device responds with a steady amber light emitting diode indication 43 and a steady tone on the piezo buzzer 44. The digital liquid crystal display shows the elapsed time between ball contact and head turning as a positive value in milliseconds 45. If the execution of the swing was not correct, and head motion preceded contact with the ball, then the device responds with a flashing red light emitting diode indication 46 and a short beeping tones on the piezo buzzer 47. The digital liquid crystal display shows the elapsed time between head turning and ball contact as a negative value in milliseconds 48. This display persists for about 10 seconds, allowing the golfer to view the results. After this, the device drops back into the Alignment task to prepare for the next shot.

The software algorithm is implemented in PIC assembly language, which is converted to machine code by processing the assembly language source code with the Microchip MPASM assembler program. The resulting executable code is tested and integrated with the device's circuitry using a Microchip PICMASTER emulation system, and the actual PIC16C55 used in the circuit is programmed with the executable code by a Microchip PROMATE device programmer. This technique of encoding a software program into a microprocessor is widely known and used by those in the field.

What is claimed is:

1. A device which monitors a golfer's head turn during a golf swing which comprises:

(a) a means for detecting when a golf club strikes a golf ball, thereby creating a ball strike time, the ball strike detecting means is connected to a microprocessor;

(b) a means for detecting when the golfer's head is aligned with the ball, the head alignment detecting means is connected to the microprocessor and comprises an optical emitter and an optical sensor, whereby the optical emitter provides a signal which is detected by the optical sensor;

(c) a means for detecting when the head alignment with the ball ceases, thereby creating a head turn time, the head turn detecting means further comprises a reflector, the reflector being fixed on or about the front of the golfer's head for reflecting the signal from the optical emitter thus providing a reflected signal, and the optical sensor detecting the reflected signal;

(d) a means for determining whether the head turn time occurs before or after the ball strike time, whereby the determining means is performed by the microprocessor which receives input of the ball strike time and the head turn time; and (e)

(e) a means for providing/feedback from the microprocessor of whether the head turn time occurred before or after the ball strike time.

2. The device as claimed in claim 1 wherein the reflector comprises a pair of eyeglasses with mirrored reflective lenses.

3. A device which monitors a golfer's head turn during a golf swing which comprises:

(a) a microprocessor which is programmed to receive a plurality of electrical signals, a means to analyze the electrical signals, and a means to provide output of a result of the analyzed signals;

(b) an optical emitter which is controlled by the microprocessor, wherein the optical emitter emits an optical signal in the direction of a golfer's head;

(c) an optical reflector placed on or about the front of the golfer's head wherein the reflector reflects the optical signal from the optical emitter;

(d) an optical sensor which detects the signal reflected from the optical reflector and converts the reflected optical signal to a first electrical signal which is sent to the microprocessor;

(e) a microphone which detects an acoustic signal and converts the acoustic signal to a second electrical signal which is sent to the microprocessor;

(f) an audio output means which is controlled by the microprocessor; and (g) a visual display controlled by the microprocessor.

4. The device as claimed in claim 3 wherein the device is powered by a battery.

5. The device as claimed in claim 3 wherein the visual display comprises a liquid crystal display and a plurality of light emitting diodes.

6. The device as claimed in claim 3 wherein the optical reflector comprises a pair of eyeglasses with mirrored reflective lenses.

* * * * *